US010602838B2

(12) United States Patent
Ou

(10) Patent No.: US 10,602,838 B2
(45) Date of Patent: Mar. 31, 2020

(54) FOLDABLE AND HEIGHT-ADJUSTABLE TABLE

(71) Applicant: Chang Hong Ou, Foshan (CN)

(72) Inventor: Chang Hong Ou, Foshan (CN)

( * ) Notice: Subject to any disclaimer, the term of this patent is extended or adjusted under 35 U.S.C. 154(b) by 0 days.

(21) Appl. No.: 15/411,924

(22) Filed: Jan. 20, 2017

(65) Prior Publication Data

US 2017/0202349 A1 Jul. 20, 2017

(30) Foreign Application Priority Data

Jan. 20, 2016 (CN) ..... 2016 2 0053578 U

(51) Int. Cl.
*A47B 3/00* (2006.01)
*A47B 9/20* (2006.01)
*A47B 9/14* (2006.01)

(52) U.S. Cl.
CPC ..... *A47B 3/002* (2013.01); *A47B 9/14* (2013.01); *A47B 9/20* (2013.01); *A47B 2003/004* (2013.01)

(58) Field of Classification Search
CPC ..... A47B 3/002; A47B 9/20; A47B 13/02; A47B 27/14
See application file for complete search history.

(56) References Cited

U.S. PATENT DOCUMENTS

2012/0228840 A1* 9/2012 Qiang ..... A47B 3/002 280/42
2016/0022027 A1* 1/2016 Grace ..... A47B 3/087 108/164
2016/0296004 A1* 10/2016 Peng ..... A47B 3/002

* cited by examiner

*Primary Examiner* — Daniel J Rohrhoff
(74) *Attorney, Agent, or Firm* — Che-Yang Chen; Law Offices of Scott Warmuth

(57) ABSTRACT

A foldable and height-adjustable table may include a main frame, a foldable frame, and a wheel assembly. The main frame has two side frames which are separated with a distance and parallel with each other. Each of the side frames has a vertical front sleeve and a vertical rear sleeve, and each of top bars horizontally located at a top end of the side frame. A table top has a pivotal side edge pivotally coupled with one of the top bars and an opposed detachable side edge detachably coupled with another top bar. The table top is configured to be coupled on tops of the top bars for use or pivotally turned over to couple at an outer edge of the side frame for store, and the main frame is configured to be folded between the folded position and unfolded position.

3 Claims, 9 Drawing Sheets

FOLDABLE AND HEIGHT-ADJUSTABLE TABLE

FIELD OF THE INVENTION

The present invention relates to a table, and more particularly to a foldable and height-adjustable table.

BACKGROUND OF THE INVENTION

Generally, a conventional table comprises a table top, and at least two vertical legs mounted on a bottom surface thereof are configured to allow the table to securely stand on the floor. Moreover, some kinds of tables may have a plurality of wheels respectively installed at lower ends of the legs thereby increasing a movability of the table.

However, the conventional table has its disadvantages because: the table has a rigid structure to support objects. Although having the wheels to improve the movability, the table is still heavy and hard to be moved and stored by a user. Therefore, there remains a need for a new and improved design for a table to overcome the problems presented above.

SUMMARY OF THE INVENTION

The present invention provides a foldable and height-adjustable table which comprises a main frame, a foldable frame, and a wheel assembly. The main frame has two side frames which are separated with a distance and parallel with each other, and each of the side frames has a vertical front sleeve and a vertical rear sleeve, which are separated with a preferred distance to define a width of the table. Moreover, each of the two front sleeves has a first opening formed at a top end thereof while each of the two rear sleeves comprises a second opening formed at a top end thereof. Each of two front vertical posts downwardly received into the front sleeve through the first openings is configured to slide in an interior space of the front sleeve. Similarly, each of two rear vertical posts downwardly received into the rear sleeve through the second openings is configured to slide in an interior space of the rear sleeve. As a result, the front posts and the rear posts are configured to be pulled upwardly with the same distance, thus achieving height-adjustable effect.

Furthermore, each of the front sleeves and the rear sleeves has a locking unit which is configured to secure the posts with the sleeves thereby fixing the height of the table. Each of the side frames has a top bar which is horizontally located at a top end thereof and is concurrently coupled with a top end of the front post and a top end of the rear post through a lower surface thereof. Similarly, each of the side frames comprises a bottom bar which is horizontally located at a bottom end thereof and is concurrently coupled with a bottom end of the front sleeve and a bottom end of the rear sleeve through a top surface thereof. Furthermore, each of the side frames comprises a supporting bar horizontally formed between the front sleeve and the rear sleeve to improve the structural strength.

A table top has a pivotal side edge pivotally coupled with one of the top bars and an opposed detachable side edge detachably coupled with another top bar. Wherein the table top is configured to be coupled with and supported by two top surfaces of the top bars at an unfolded position, and a length of the table top, which is a distance between the pivotal side edge and the detachable side edge, correspondingly matches with a distance between the two top bars at the unfolded position. In addition, an H-shaped first supporting member is horizontally coupled between the two bottom bars, and two top ends and two bottom ends of the H-shaped first supporting member are respectively coupled with the two bottom bars of the two side frames between the front sleeves and the rear sleeves. The first supporting member comprises two U-shaped members which are horizontally and pivotally coupled with each other edge-to-edge through two bottom portions thereof to form an H shape, and a first pivot edge is formed between the two bottom portions of the two U-shaped members.

A second supporting member horizontally coupled between the two side frames comprises a cross bar and an arc bar. Two ends of the cross bar are respectively and pivotally coupled with the two front sleeves, and the cross bar comprises two parts pivotally and edge-to-edge connected with each other at a first pivot point of the cross bar; wherein two ends of the arc bar are respectively and pivotally coupled with the two rear sleeves, and the arc bar has two portions pivotally and edge-to-edge connected with each other at a second pivot point of the arc bar; and wherein the cross bar and the arc bar are connected to each other to allow the first pivot point to horizontally align with the second pivot point. The foldable frame coupled between the two side frames comprises a vertical transmission link, a sliding joint, two folding arms, a retention stopper, and a shelf locker. The transmission link penetrating through a sliding through hole of the sliding joint has a first upper end and a first lower end. The first upper end is pivotally coupled with the second supporting member to allow the first upper end to horizontally align with the first pivot point, and the first lower end is pivotally coupled with the first supporting member and is horizontally aligned with the first pivot edge.

The sliding joint slidably coupled with the transmission link is configured to slide along the transmission link between the upper end and the lower end thereof. Furthermore, the sliding joint has two side wings respectively extended from both lateral edges thereof. The two folding arms are movably and pivotally coupled with the two side wings of the sliding joint at two upper ends thereof respectively, and two lower ends of the two folding arms are movably and pivotally coupled with the first supporting member respectively at both lateral sides of the transmission link so as to retain a distance between the two side frames at the unfolded position. Moreover, each of the folding arms is extended in an inclined manner to form a triangular configuration between the side frames and the transmission link. The retention stopper is provided at the first upper end of the transmission link to bias against the sliding joint when the sliding joint is slid at the upper end of the transmission link at the unfolded position so as to prevent any further upward sliding movement of the sliding joint, thereby securing the main frame at the unfolded position. The shelf locker coupled on the foldable frame is configured to releasably lock the foldable frame at the unfolded position.

The wheel assembly comprises a plurality of lockable wheels which are respectively installed at two bottom surfaces of the two bottom bars for enhancing the mobility of the foldable and height-adjustable table, and each of locking members positioned adjacent to the wheel is configured to lock the wheel thus achieving the stability of the table.

Comparing with conventional table, the present invention is advantageous because: the table top is configured to be coupled on the top surfaces of the two top bars for use or be pivotally turned over and coupled at an outer edge of the side frame for store, and the main frame is configured to be folded between the folded position and unfolded position, which is convenient for use, store and move.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
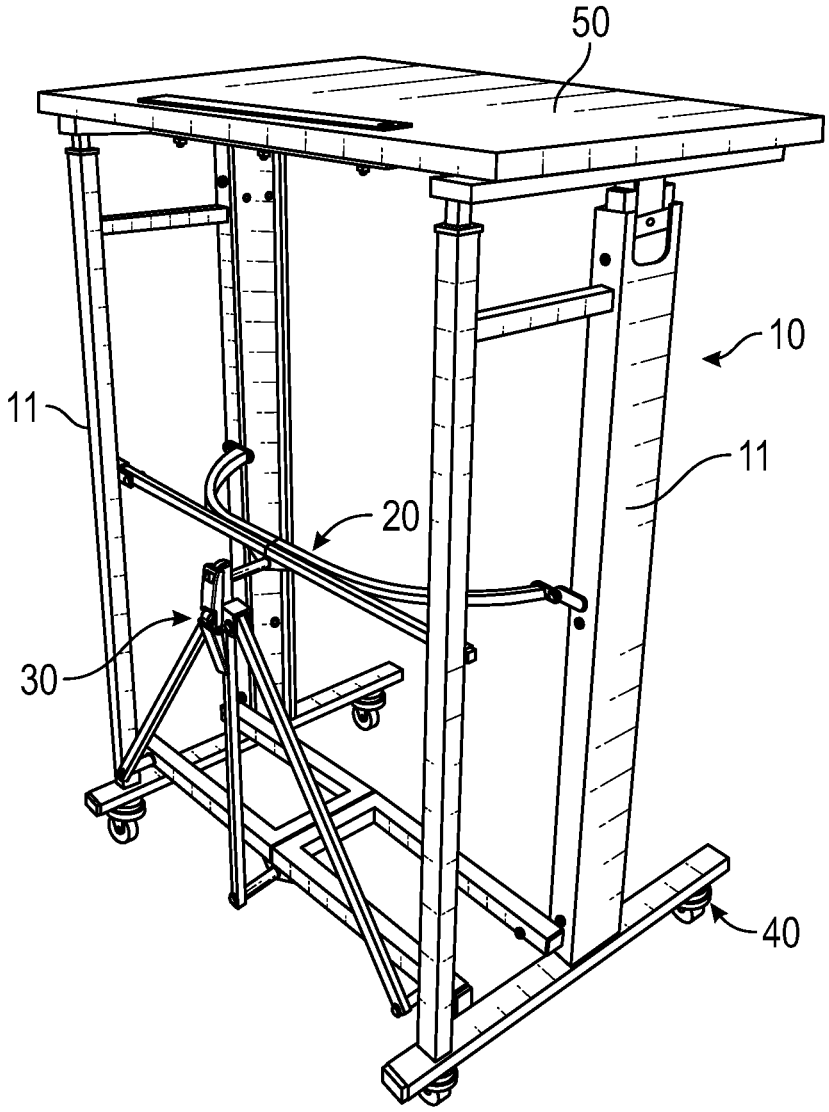
FIG. 1 is a three-dimensional assembly view of a foldable and height-adjustable table of the present invention at an unfolded position.
Figure 2:
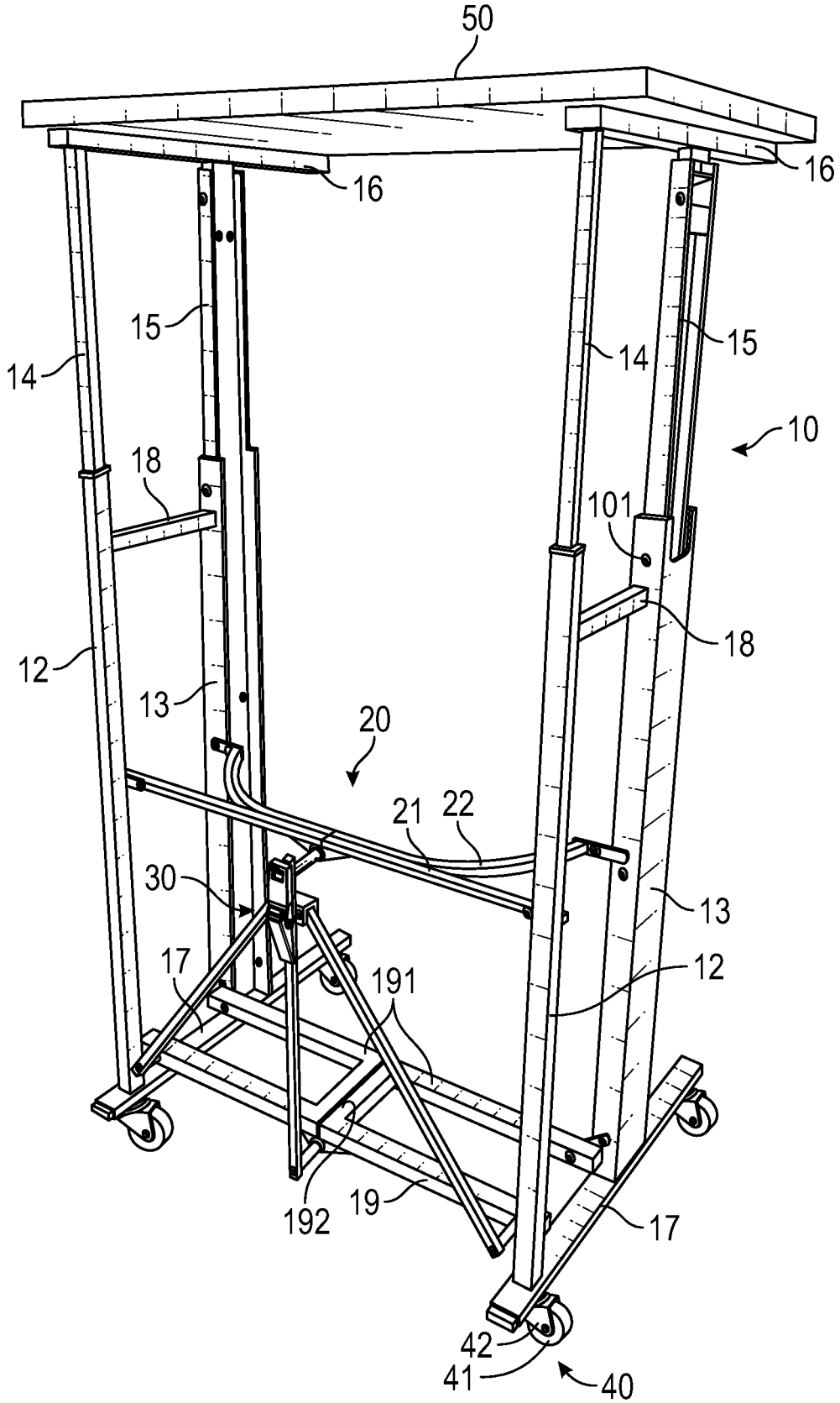
FIG. 2 is a three-dimensional assembly view of the foldable and height-adjustable table of the present invention at the unfolded position after adjusting a height of the table.
Figure 3:
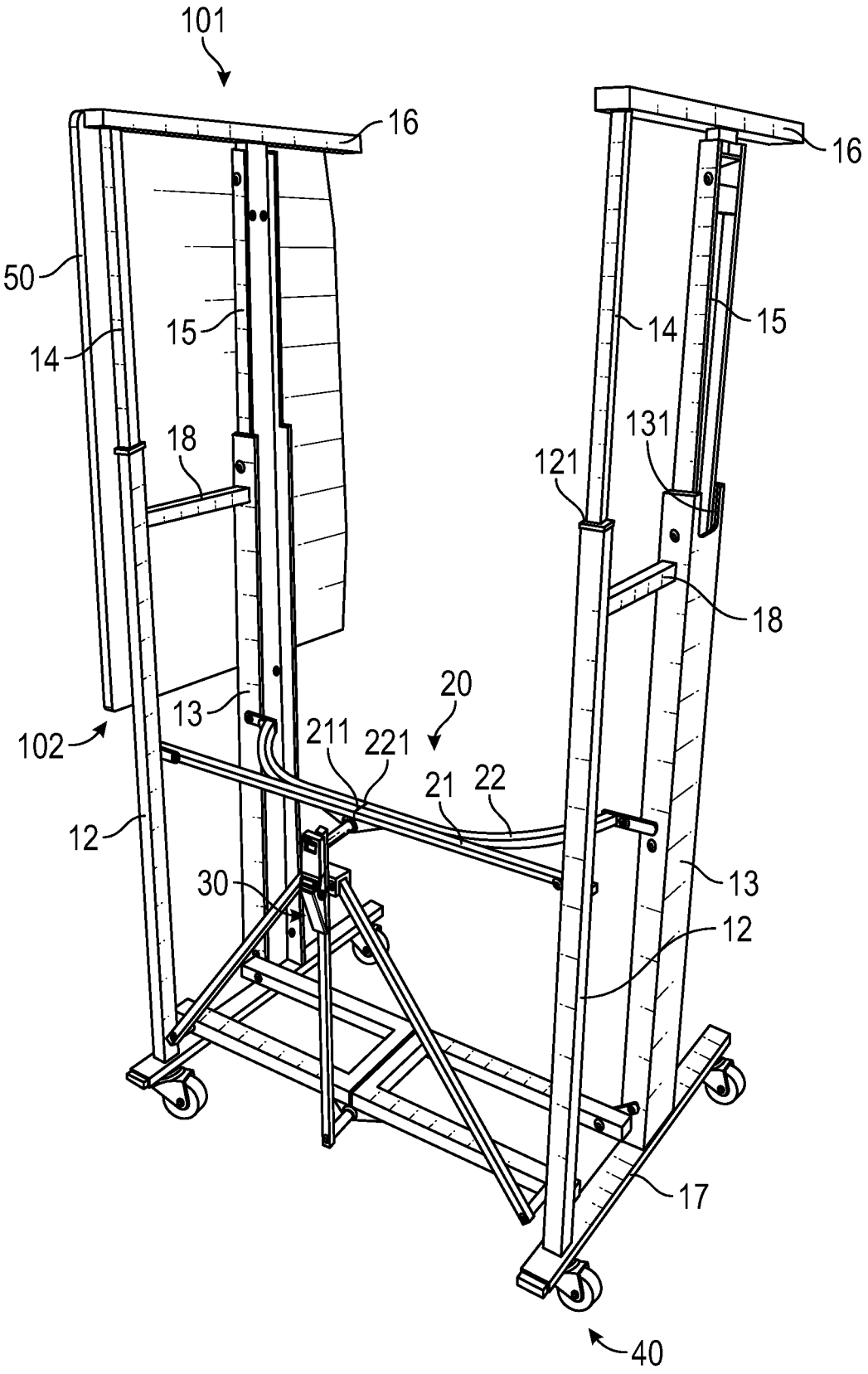
FIG. 3 is a three-dimensional assembly view illustrating a table top is turned over and coupled at an outer edge of a side frame of the foldable and height-adjustable table at the unfolded position in the present invention.
Figure 4:
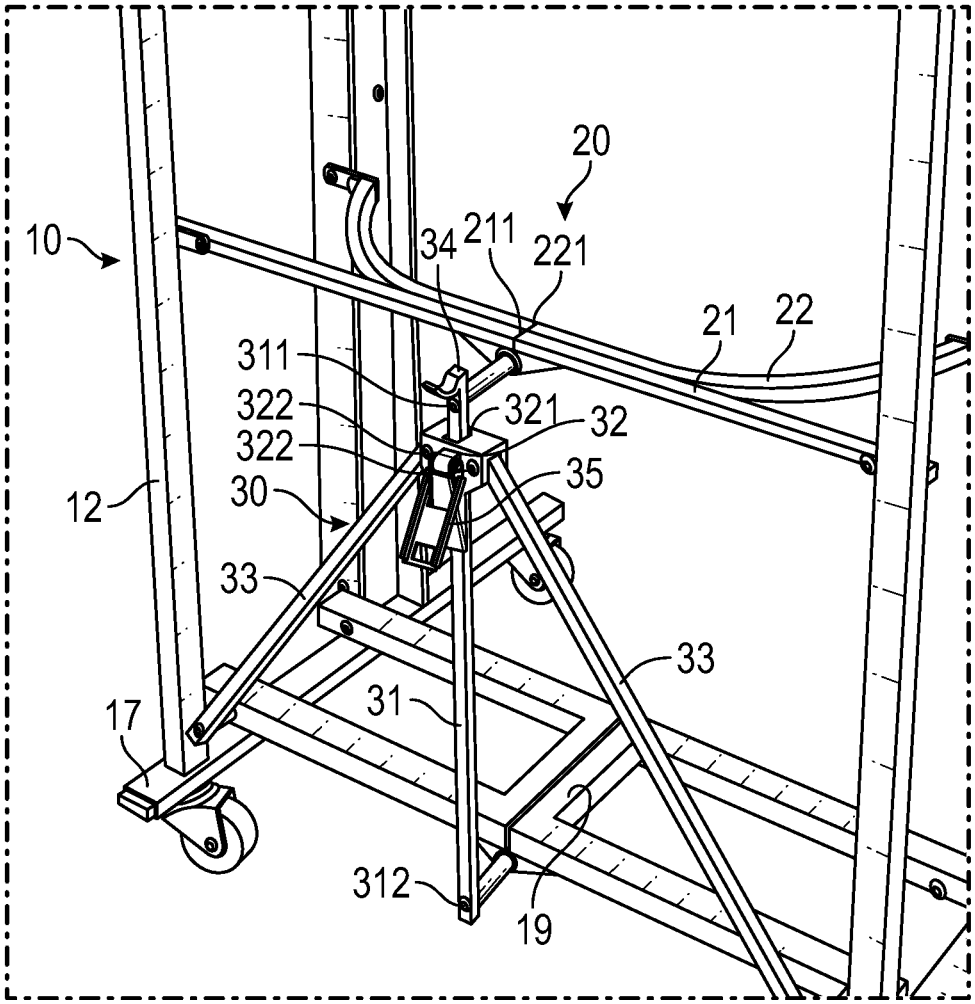
FIG. 4 is a three-dimensional assembly view illustrating a foldable frame of the foldable and height-adjustable table of the present invention is at the unfolded position.

In order to further understand the goal, characteristics and effect of the present invention, a number of embodiments along with the drawings are illustrated as following:

Referring to FIGS. 1 to 4, the present invention provides a foldable and height-adjustable table which comprises a main frame (10), a second supporting member (20), a folding control unit (30), a wheel assembly (40), and a table top (50). The main frame (10) has two side frames (11) which are separated with a distance and parallel with each other, and the distance between two side frames (11) is nearly the length of the table top (50). Each of the side frames (11) has a vertical front sleeve (12) and a vertical rear sleeve (13), which are separated with a predetermined distance. Moreover, each of the two front sleeves (12) has a first opening (121) formed at a top end thereof while each of the two rear sleeves (13) comprises a second opening (131) formed at a top end thereof. Each of two front vertical posts (14) downwardly received into the front sleeve (12) through the first openings (121) is configured to slide in an interior space of the front sleeve (12). Similarly, each of two rear vertical posts (15) downwardly received into the rear sleeve (13) through the second openings (131) is configured to slide in an interior space of the rear sleeve (13). As a result, the front posts (14) and the rear posts (15) are configured to be pulled upwardly with the same distance, so the height of the table can be easily adjusted as shown in FIGS. 1 and 2.

Furthermore, each of the front sleeves (12) and the rear sleeves (13) has a locking unit (101) which is configured to secure the posts (14)(15) with the sleeves (12)(13) thereby fixing the height of the table. Each of the side frames (11) has a top bar (16) which is horizontally located at a top end thereof and is concurrently coupled with a top end of the front post (14) and a top end of the rear post (15) through a lower surface thereof.

Similarly, each of the side frames (11) comprises a bottom bar (17) which is horizontally located at a bottom end thereof and is concurrently coupled with a bottom end of the front sleeve (12) and a bottom end of the rear sleeve (13) through a top surface thereof. Furthermore, each of the side frames (11) comprises a supporting bar (18) horizontally formed between the front sleeve (11) and the rear sleeve (12) to improve the structural strength. The table top (50) has a pivotal side edge (101) pivotally coupled with one of the top bars (16) and an opposed detachable side edge (102) detachably coupled with another top bar (16). The table top (50) is configured to be coupled with and supported by two top surfaces of the top bars (16) at an unfolded position, and a length of the table top (50), which is a distance between the pivotal side edge (101) and the detachable side edge (102), correspondingly matches with a distance between the two top bars (16) at the unfolded position.

In addition, an H-shaped first supporting member (19) is horizontally coupled between the two bottom bars (17), and two top ends and two bottom ends of the H-shaped first supporting member (19) are respectively coupled with the two bottom bars (17) of the two side frames (11) between the front sleeves (12) and the rear sleeves (13). Wherein the first supporting member (19) comprises two U-shaped members (191) which are horizontally and pivotally coupled with each other edge-to-edge through two bottom portions thereof to form an H shape, and a first pivot edge (192) is formed between the two bottom portions of the two U-shaped members (191). A second supporting member (20) horizontally coupled between the two side frames (11) comprises a cross bar (21) and an arc bar (22). Two ends of the cross bar (21) are respectively and pivotally coupled with the two front sleeves (12), and the cross bar (21)

comprises two parts pivotally and edge-to-edge connected with each other at a first pivot point (211) of the cross bar (21); wherein two ends of the arc bar (22) are respectively and pivotally coupled with the two rear sleeves (13), and the arc bar (22) has two portions pivotally and edge-to-edge connected with each other at a second pivot point (221) of the arc bar (22); and wherein the cross bar (21) and the arc bar (22) are connected to each other to allow the first pivot point (211) to horizontally align with the second pivot point (221). The folding control unit (30) coupled between the two side frames (11) comprises a vertical transmission link (31), a sliding joint (32), two folding arms (33), a retention stopper (34), and a shelf locker (35). The transmission link (31) penetrating through a sliding through hole (321) of the sliding joint (32) has a first upper end (311) and a first lower end (312). The first upper end (311) is pivotally coupled with the second supporting member (20) to allow the first upper end (311) to horizontally align with the first pivot point (211), and the first lower end (312) is pivotally coupled with the first supporting member (19) and is horizontally aligned with the first pivot edge (192). The sliding joint (32) slidably coupled with the transmission link (31) is configured to slide along the transmission link (31) between the upper end (311) and the lower end (312) thereof. Furthermore, the sliding joint (32) has two side wings (322) respectively extended from both lateral edges thereof. The two folding arms (33) are movably and pivotally coupled with the two side wings (322) of the sliding joint (32) at two upper ends thereof respectively, and two lower ends of the two folding arms (33) are movably and pivotally coupled with the first supporting member (19) respectively at both lateral sides of the transmission link (31) so as to retain a distance between the two side frames (11) at the unfolded position. Moreover, each of the folding arms (33) is extended in an inclined manner to form a triangular configuration between the side frames (11) and the transmission link (31). The retention stopper (34) is provided at the first upper end (311) of the transmission link (31) to bias against the sliding joint (32) when the sliding joint (32) is slid at the upper end (311) of the transmission link (31) at the unfolded position so as to prevent any further upward sliding movement of the sliding joint (32), thereby securing the main frame (10) at the unfolded position. The shelf locker (35) coupled on the folding control unit (30) is configured to releasably lock the folding control unit (30) at the unfolded position. The wheel assembly (40) comprises a plurality of lockable wheels (41) which are respectively installed at two bottom surfaces of the two bottom bars (17) for enhancing the mobility of the foldable and height-adjustable table, and each of locking members (42) positioned adjacent to the wheel (41) is configured to lock the wheel (41) thus achieving the stability of the table.

Figure 5:
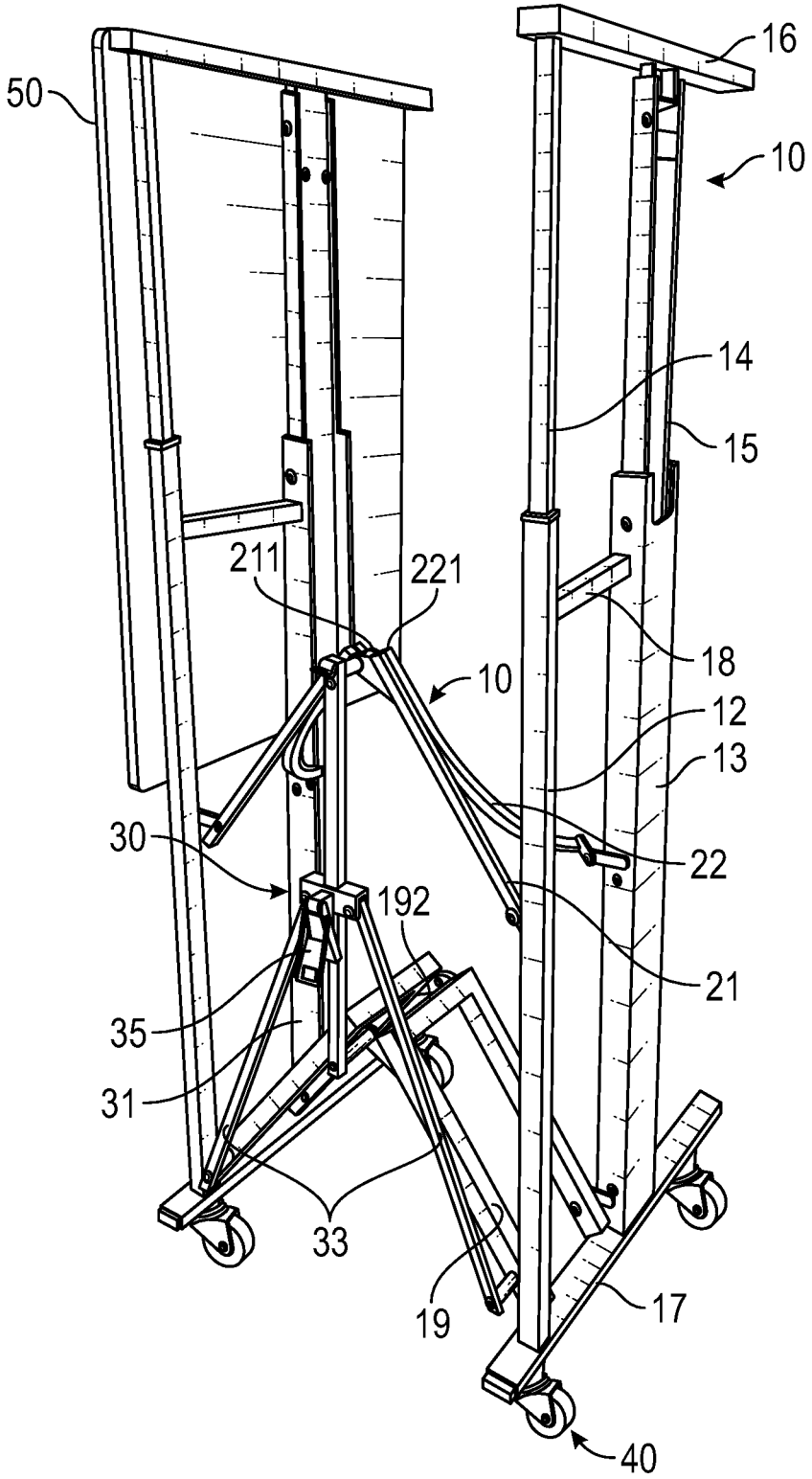
FIG. 5 is a three-dimensional assembly view illustrating the foldable and height-adjustable table of the present invention is folded into a folded position.
Figure 6:
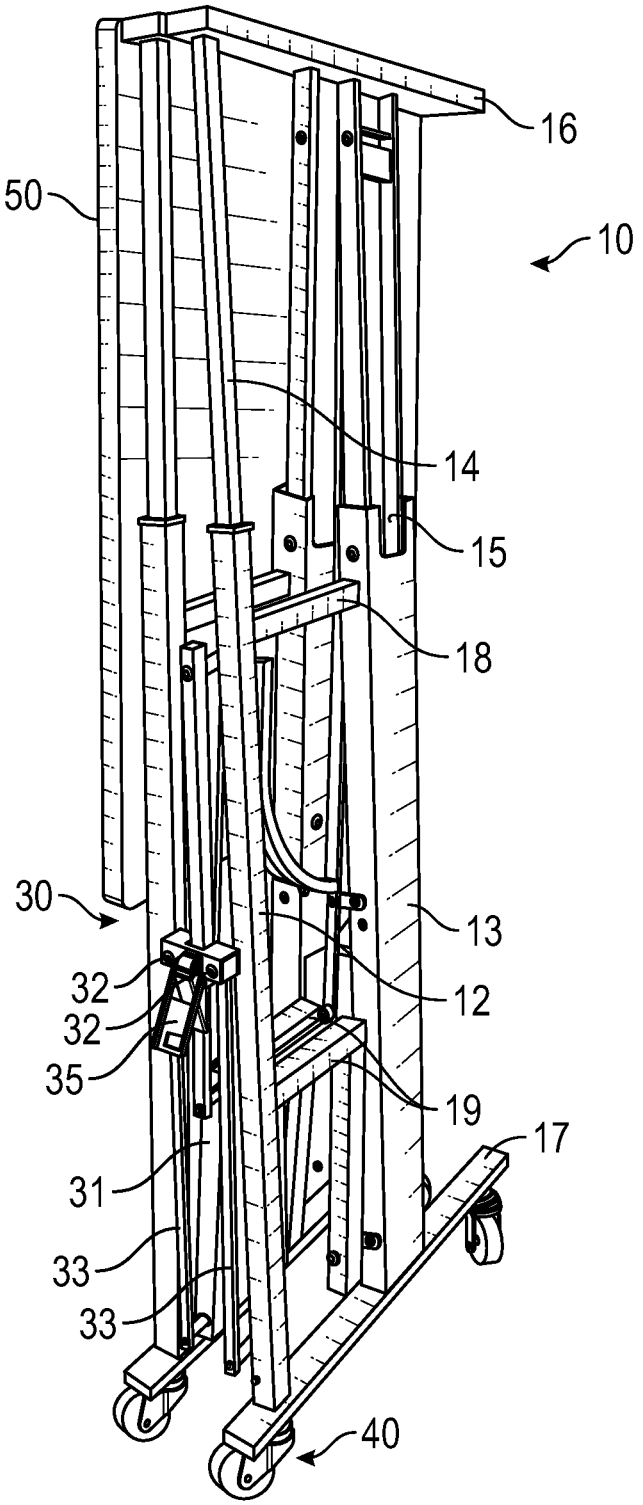
FIG. 6 is a three-dimensional assembly view illustrating the foldable and height-adjustable table of the present invention is fully folded at the folded position.

Referring to FIGS. 5 and 6, in the folding process, a user can use the pivotal side edge (101) as a pivot to turn over the table top (50) such that the detachable side edge (102) turned about the pivotal edge (101) is configured to detach from the top bar (15) of one side frame (11) and to couple with an outer edge of another side frame (11). Then, the user can move the transmission link (31) upwardly at a vertical direction. Concurrently, the first pivot edge (192) of the first supporting member (19), the first pivot point (211) of the cross bar (21), and the second pivot point (221) of the arc bar (22) are pulled upwardly such that each of the U-shaped members (191) of the first supporting member (19), the two parts of the cross bar (21), and the two portions of the arc bar (22) are respectively configured to be overlapped with each other, and the two side frames (11) are configured to be moved toward each other to achieve a folded position.

Figure 7:
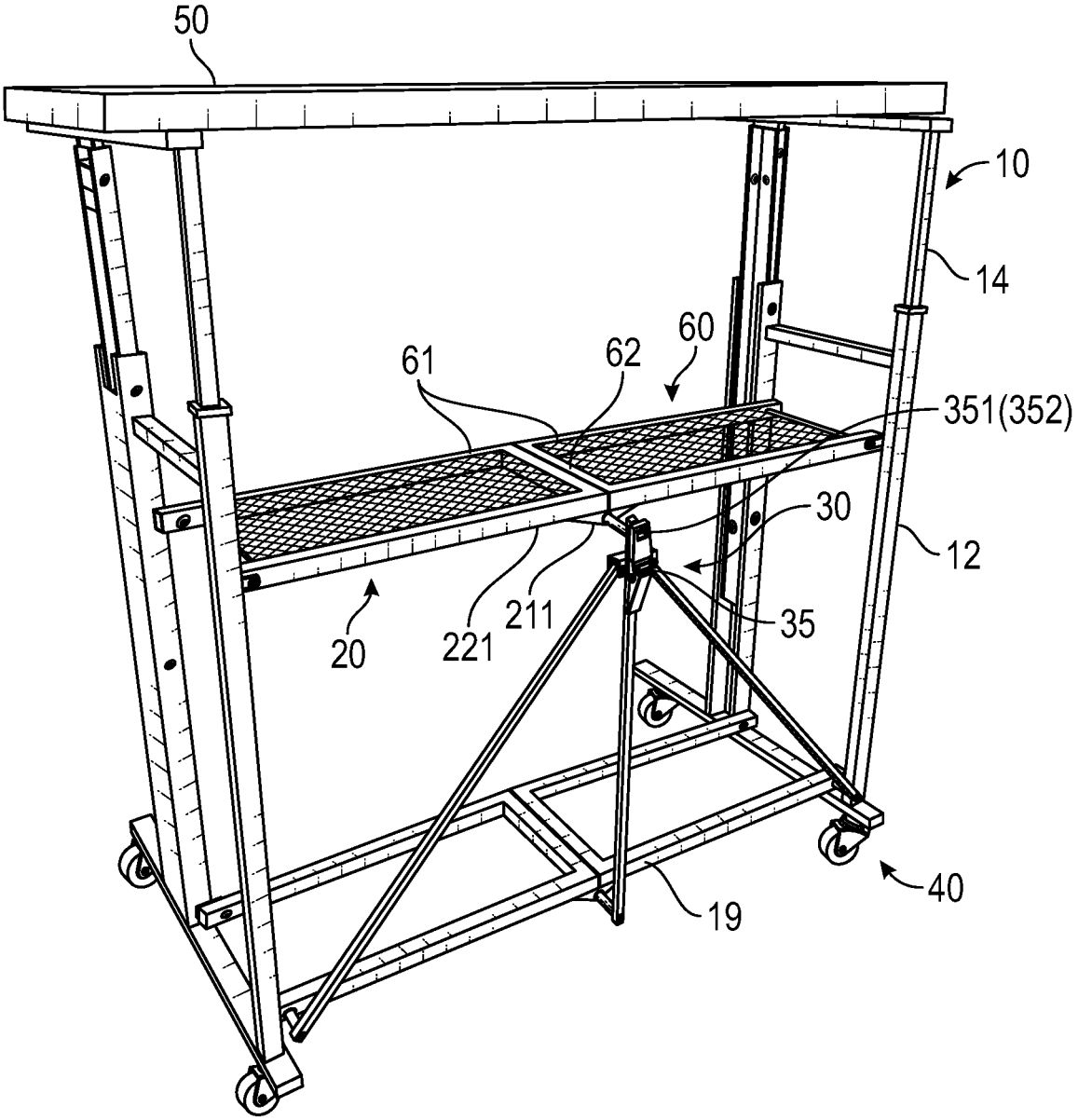
FIG. 7 is a three-dimensional assembly view illustrating a shelf panel is coupled on a second supporting member of the foldable and height-adjustable table at the unfolded position in the present invention.

In one embodiment, referring to FIG. 7, an H-shaped foldable shelf panel (60) is configured to be coupled on the second supporting member (20) between the two side frames (11). The shelf panel (60) comprises two U-shaped side panels (61) which are horizontally and pivotally coupled with each other at bottom edges thereof to form a planar configuration thus allowing objects to be placed thereon, and a third pivot point (62) formed between the bottom edges of the side panels (61) is aligned with the first pivot point (211) and the second pivot point (221).

Figure 8:
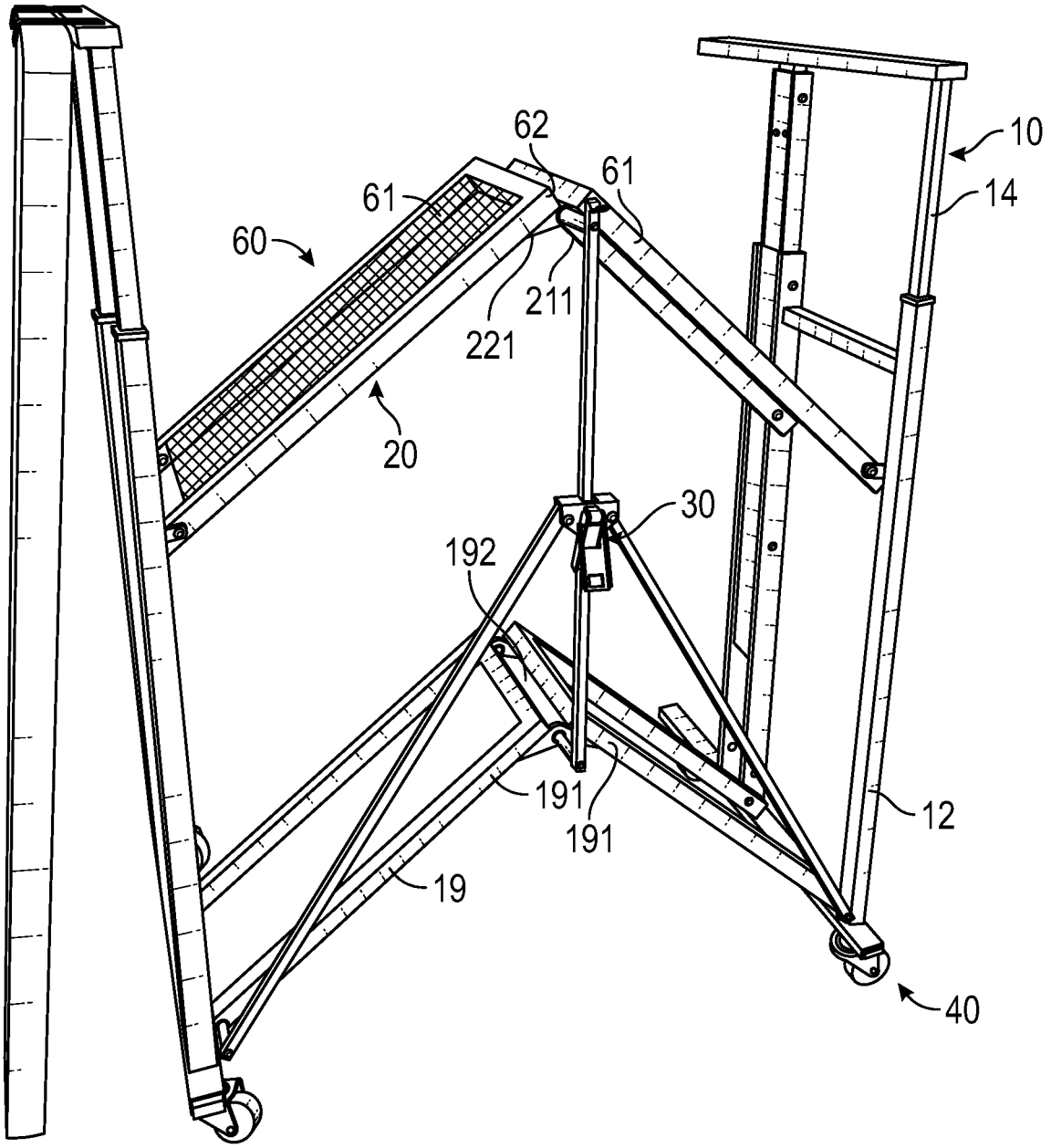
FIG. 8 is a three-dimensional assembly view illustrating the shelf panel is folded concurrently with the second supporting member of the foldable and height-adjustable table of the present invention during the folding process.
Figure 9:
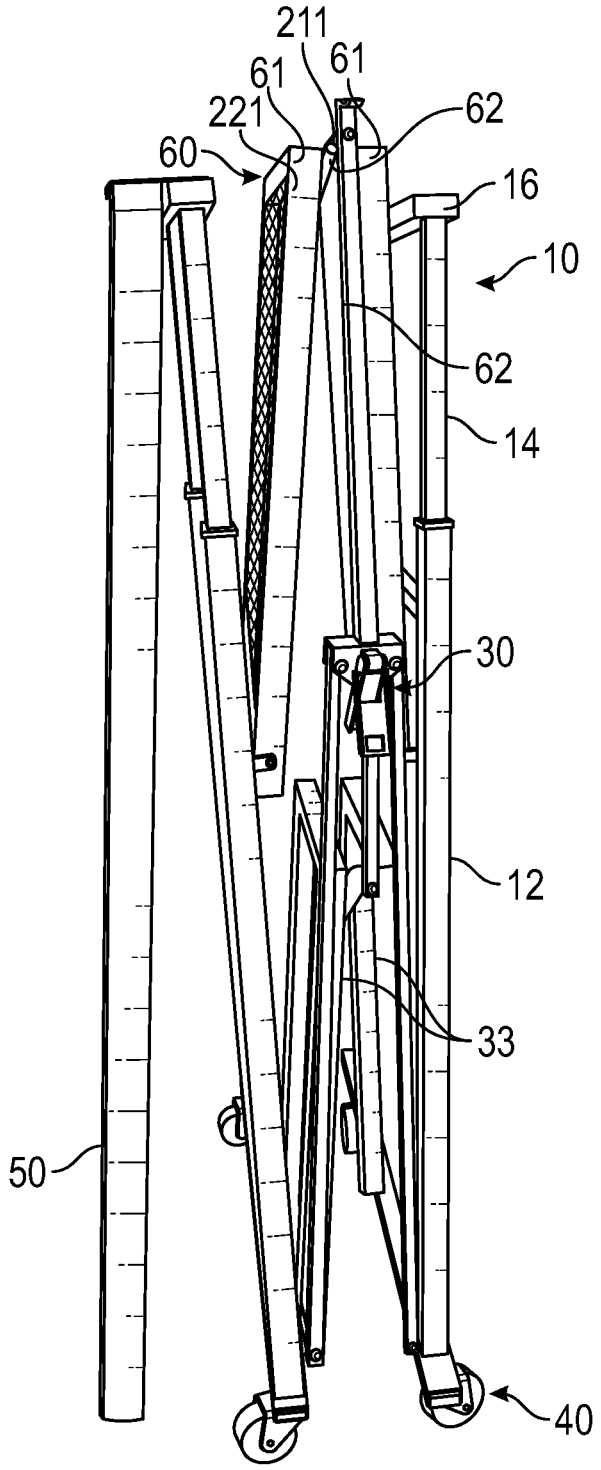
FIG. 9 is a three-dimensional assembly view illustrating the foldable and height-adjustable table with the shelf panel in the present invention is fully folded into the folded position.

Furthermore, when the transmission link (31) is moved upwardly at a vertical direction, the shelf panel (60) driven by the second supporting member (20) is pivotally and concurrently folded to overlap the two corresponding side panels (61) (as shown in FIGS. 8 and 9). Likewise, when the transmission link (31) is moved downwardly at a vertical direction, the shelf panel (60) driven by the second supporting member (20) is pivotally and concurrently folded at a position that the corresponding side panels (61) are folded edge-to-edge in a single planar configuration.

Moreover, when the folding control unit (30) is folded to its folded position, the sliding joint (33) is slid along the transmission link (31) away from the first upper end thereof (311) to allow the two side frames (11) to move toward each other. When the folding control unit (30) is extended to its unfolded position, the sliding joint (33) is slid along the transmission link (31) toward and at the upper end thereof, thus fully extending the distance between the side frames (11).

In another embodiment, a bottom surface of the table top (50) has two elongated grooves (103) at positions corresponding to the top bars (16), and when the table top (50) is used at the unfolded position, the two top bars (16) are respectively received in the two elongated grooves (103), thereby increasing the stability of the table top (50).

In still another embodiment, the locking unit (101) is a bolt, and each of the front posts (14) and the rear posts (15) has a row of through holes (110) which are configured to selectively be penetrated by the bolt, thus securing the height of the table.

In still a further embodiment, the shelf locker (35) comprises a first locker (351) provided at the upper end (311) of the transmission link (31) and a second locker (352) provided at the sliding joint (32) to releasably engage with the first locker (351) when the sliding joint (32) is slid to bias against the retention stopper (34).

Comparing with conventional table, the present invention is advantageous because: the table top (50) is configured to be coupled on the top surfaces of the two top bars for use or pivotally turned over and coupled at an outer edge of the side frame (11) for store, and the main frame (10) is configured to be folded between the folded position and unfolded position, which is convenient for use, store and move.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A foldable and height-adjustable table having a folded position and an unfolded position comprising:

a table top;

a main frame having two side frames that are parallel and separated with each other for a predetermined distance that is substantially equal to a length of the table top; each of the side frames having a top bar that is horizontally located at a top end thereof, and a folding control unit located between said two side frames and pivotally connected thereto, the folding control unit having a vertical transmission link, a sliding joint, two folding arms, a retention stopper, and a shelf locker, wherein the table top has a pivotal side edge pivotally coupled with one of the top bars and an opposed detachable side edge detachably coupled with another top bar, wherein the transmission link penetrating through a sliding through hole of the sliding joint has a first upper end and a first lower end; the first upper end is pivotally coupled with a second supporting member to allow the first upper end to horizontally align with the first pivot point, and the first lower end is pivotally coupled with a first supporting member and is horizontally aligned with the first pivot edge, and the sliding joint slidably coupled with the transmission link is configured to slide along the transmission link between the upper end and the lower end thereof to change the table's configuration between the folded and unfolded positions.

2. The foldable and height-adjustable table of claim 1, wherein each of the two side frames has a vertical front sleeve and a vertical rear sleeve, which are separated with a predetermined distance; each of the two front sleeves has a first opening formed at a top end thereof while each of the two rear sleeves has a second opening formed at a top end thereof.

3. The foldable and height-adjustable table of claim 1, wherein a pair of front vertical posts are configured to be received into the front sleeve through the first openings, while a pair of rear vertical posts are configured to be received into the rear sleeve through the second openings, and the front posts and the rear posts are configured to be simultaneously pulled up and pushed to adjust the height of the table.

* * * * *